United States Patent [19]

Baba

[11] 3,947,935

[45] Apr. 6, 1976

[54] LEA MAKING APPARATUS

[76] Inventor: Tomokiyo Baba, 117, Yagisawa, Ohaza, Uedashi, Nagano, Japan

[22] Filed: Sept. 10, 1973

[21] Appl. No.: 395,843

[52] U.S. Cl. ..... 28/21; 28/72 SP

[51] Int. Cl.[2] ..... B65H 55/00

[58] Field of Search ..... 28/21, 72 SP; 289/1.5, 289/17, 18

[56] References Cited

UNITED STATES PATENTS

| | | | |
|---|---|---|---|
| 293,164 | 2/1884 | Grimshaw | 28/21 |
| 460,665 | 10/1891 | Simon | 28/21 |
| 663,925 | 12/1900 | Nordmann | 28/21 |
| 1,830,279 | 11/1931 | Langwieler | 28/21 |
| 2,268,727 | 1/1942 | Taylor et al. | 28/21 |
| 3,323,189 | 6/1967 | Hayashi | 28/21 |
| 3,626,430 | 12/1971 | Ohta | 28/21 |
| 3,656,215 | 4/1972 | Tanno | 28/21 |

*Primary Examiner*—Mervin Stein
*Attorney, Agent, or Firm*—Oblon, Fisher, Spivak, McClelland & Maier

[57] ABSTRACT

A lea making mechanism of a reeling machine has a cylinder movable up and down and having a tapered face and a rod secured to a piston of the cylinder. The piston has a pointed head adapted to be received through the hank threads. The mechanism also comprises a set of inwardly curved pipes through which the lea thread is led.

During the operation of the mechanism, the cylinder only is forced downward and the tapered face pushes open the set of pipes and then the cylinder is raised to pull up the lea thread extending through the hank threads.

1 Claim, 12 Drawing Figures

LEA MAKING APPARATUS

DETAILED EXPLANATION OF THE INVENTION

This invention relates to a lea making apparatus for mechanically handling the hank threads conventionally wound on the lea frame of a reeling machine.

In general, in order to prepare for a dyeing process of reeled or hank threads, the reeled thread must be bound. The requisites necessary for the bound conditions of the hank threads are as follows:

a. not fraying of hank threads, not expanding of ends of hank threads bound by leas beyond the predetermined limit, c. during the dyeing process, having a fixed compactness of thread bundle without making a very tightly twisted portion.

d. easy removing of the unnecessary hank thread and good unwinding quality of hank thread. In the prior art, the binding of hank thread is carried out on manual or machine work.

The binding operation of hank is generally executed by using a chain stitch method or single lea thread which is shaped in $\alpha$ and untied at the crossing-point. The conventional chain stitch method of binding hank threads has various disadvantages, namely the hank threads must be divided or bundled by the lea chain and the bundles of hank threads must be respectively stitched or combined with each other on the intermediate portions of the bundles, so that a degree of freedom of the hank thread within the chain or lea thread is considerably restricted and the leas are hung together.

Accordingly, not only the hank thread is dyed variegatedly or spottedly but also the lea thread can not be pulled out easily. However, according to the present invention, owing to the shape of $\alpha$ and untied condition of lea thread, hank threads are so bundled as to have a relatively high degree of freedom. Consequently, each bundle of hank threads can be moved to each other, thus any harmful influence is not exerted upon the dyeing process or dyed products and the hank thread is extracted easily. Nowadays, this method using single lea thread shaped as $\alpha$ is greatly appreciated.

However, the merit of the method using single lea thread $\alpha$-shaped leads to demerit. Namely, both end portions of lea thread cross each other at the point situated between the adjacent bundles of hank threads and overall length of the lea thread is restricted, so that when a few of hank thread bundles occupy larger space of the chain stitch, the remaining bundles will be subjected to pressure and all bundles of hank threads will be not uniformed in the compactness of them. Conventionally, for example, as the size of woolen yarn becomes large, the yarn must be divided in the increased number of bundles. In such a case, the compactness and uniform relation of the bundles of hank threads becomes complicated and as a result adverse effects occur during the dyeing process of the hank threads.

An object of the present invention is to provide an improved lea so as to solve the shortcomings of the conventional lea making process and of the lea itself.

The further object of the present invention is to provide an apparatus for tying threads.

Further and other objects will be apparent from a reading of the following description, especially when considered in combination with the accompanying drawings, wherein like numerals refer to like parts.

Figure 1:
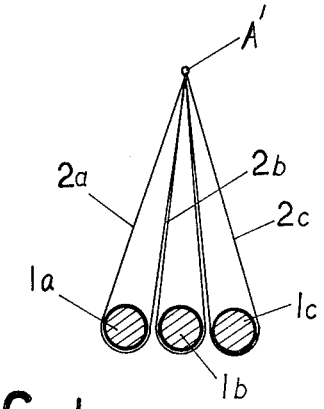
FIG. 1 is a view of the lea produced according to the present invention.
Figure 9:
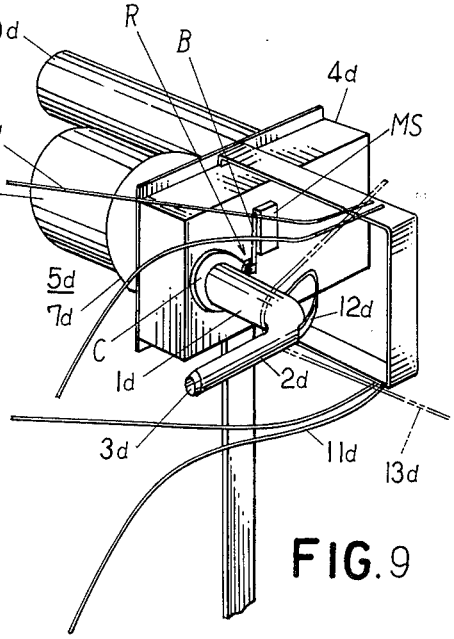
Figure 10:
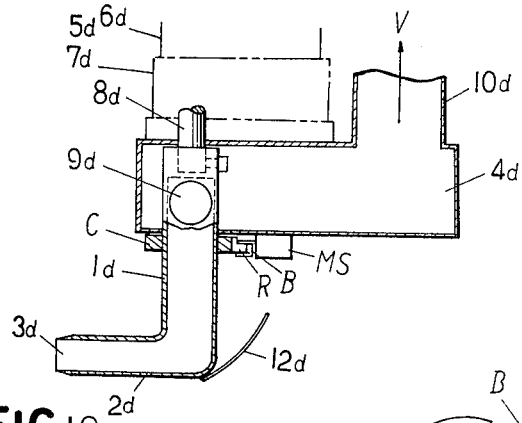
Figure 11:
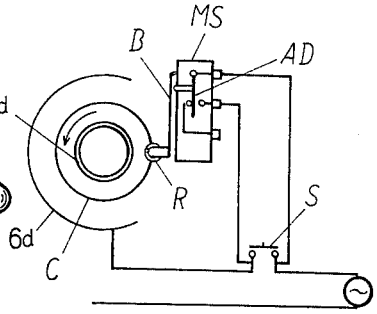
Figure 12:
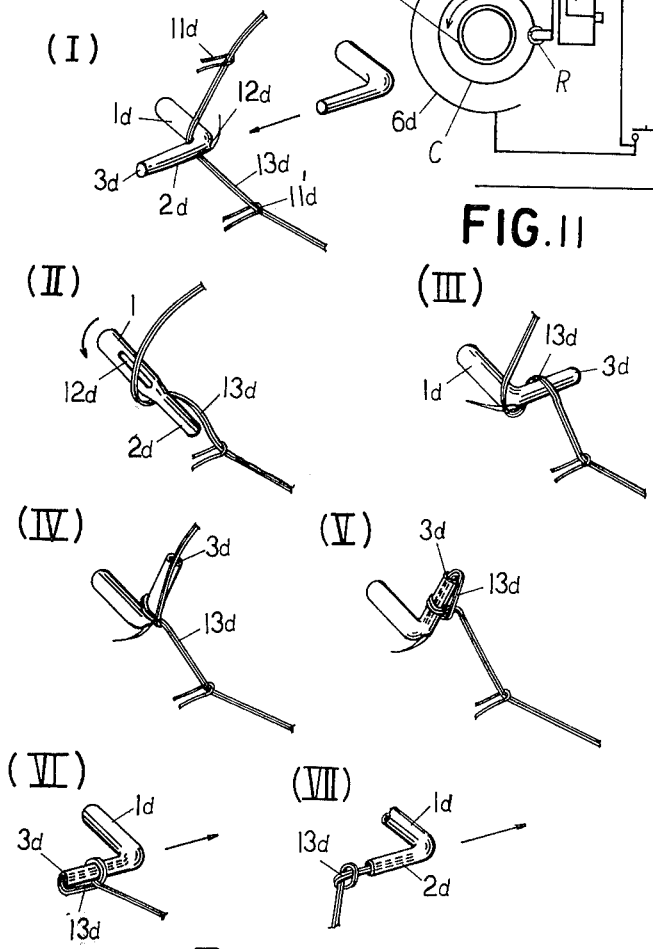

FIG. 9 is a perspective view of the apparatus for tying threads according to the present invention, FIG. 10 is a sectional plan view of important parts of the apparatus of FIG. 9, FIG. 11 is an explanatory view of an automatic stop mechanism, and FIG. 12 (1) – (7) are respectively perspective explanatory views showing the thread tying operation of the apparatus stepwise. de Referring to FIG. 1, the lea according to the present invention has a plurality of bundles of hank threads (1*a*), (1*b*) and (1*c*) and a plurality of chains of lea threads (2*a*), (2*b*) and (2*c*) loosely surrounding said bundles. As shown in FIG. 1, each end of the chains of lea threads are collected and combined at a point A′.

Figure 2:
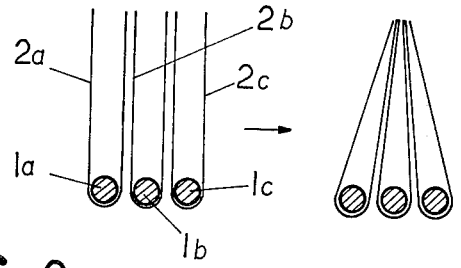
FIGS. 2 and 3 show the process for making the lea of FIG. 1.
Figure 3:
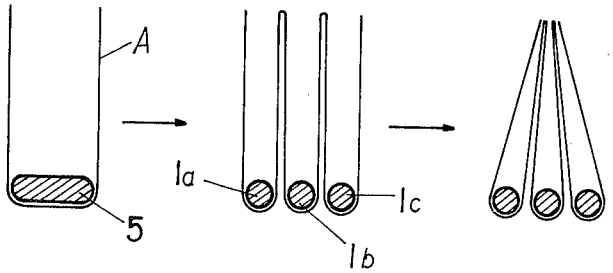

As apparent from the prior art, leas are made or formed on a hank frame. According to the present invention, the leas of this invention are made or bundled by surrounding hank threads by a plurality of lea threads (2*a*), (2*b*) and (2*c*) of U-shape (see FIG. 2). Then the free ends of the lea threads may be collected and combined as shown in FIG. 2. The lea thread 2 lengthwise surrounding the hank thread 1*a* pierces from one side to the other of the hank thread so as to make a continuous series of U-shaped leas and to divide the hank thread into a plurality of bundles. The free ends of the U-shaped lea threads may be closed and the closed ends may be collected together. In either case of opening and closing the free ends of the U-shaped lea threads, the ends of lea threads essentially must be collected and combined together with the ends of hank threads.

According to the present invention, the ends of lea threads collected at the point A may be tied to each other or firmly bound through another means of yarn. Thee lea chains (2*a*), (2*b*) and (2*c*) thus formed have to be shaped so as to have a size sufficiently larger than that of each hank thread bundle so as to loosely surround the hank thread bundle.

The practical method for shaping the lea chains will be described as follows. First, the imaginary perpendicular line extending through the mid point of the width of the hank thread is determined and then the combined ends of the lea thread chains are pulled up, so as to make a straight line of the lea threads. It is adequate to double the length of the combined portion of the lea threads as much as the width of the hank thread, so that a plurality of separate lea thread rings or chains having an uniform size can be obtained.

From the foregoing it will be apparent that the separate lea thread chains of the present invention combined together at their portions, so that it becomes easy to considerably lengthen the length of the lea thread chains and the length can be determined or selected arbitrarily. However, the largest size of the lea thread chains according to the conventional chain stitch method is limited.

Consequently, according to the present invention, a necessary, sufficient and uniform freedom is provided in the respective hank thread bundled and even the hank thread is swelled and spread during the dyeing process, they are not at all to be locally bound.

Conventionally, the hank threads have been bundled also by using single lea thread shaped in $\alpha$ and untied at the crossing point of the thread and by chain stitch rings of the lea threads.

According to the present invention, the primary object of the invention is to make a plurality of separate lea thread chains loosely surrounding the bundle of hank threads in order to divide them into a plurality of bundles and also to make leas in $\alpha$.

Figure 4:
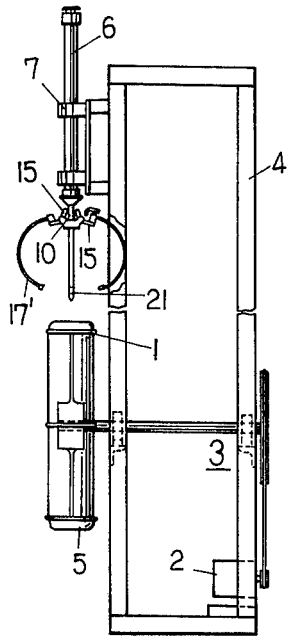
FIG. 4 shows a front view of the lea making mechanism of the present invention.
Figure 5:
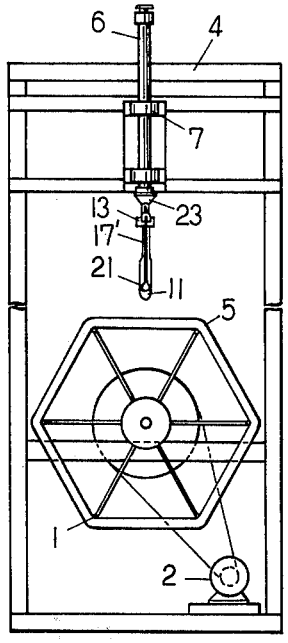
FIG. 5 is a side view of the mechanism.
Figure 6:
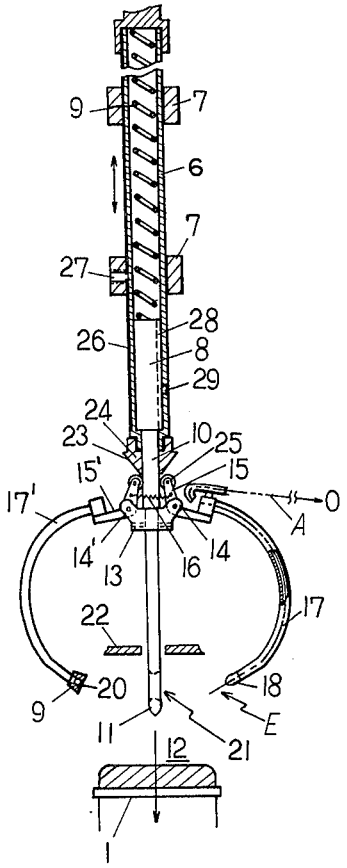
FIG. 6 is an enlarged front view of the particular portion of the mechanism, FIGS. 7(*a*)–(*f*) are illustrative views of the operation.

Turning now to FIG. 4 and FIG. 5, the hank thread frame 1 for example hexagonal is mounted on the machine frame 4. The hank thread frame 1 is adapted to be revolved by an electric motor 2 and a transmission mechanism 3. After a suitable volume of hank thread is wound around the hank thread frame 1, two sides of the hexagonal frame are stopped in horizontal position as shown in FIG. 5. Then a pin (not shown) is actuated by a suitable actuating means such as a solenoid and inserted through an opening formed on a plate secured to the hank thread frame 1. According to an illustrated embodiment of the present invention, a cylinder 6 is adapted to be moved slidably up and down by means of a hydraulic cylinder (not shown) mounted to said machine frame 4. As shown in FIGS. 4 and 5, the cylinder 6 is pending through the bearing metal 7 mounted on the upper portion of the machine frame 4.

Within a lower portion of the cylindrical bore of said cylinder 6, a piston 8 is accomodated and pressed by a spring 9. The piston 8 has a rod 10 integrally formed with the piston and extending downwards. Said rod 10 is formed to have a pointed portion 11 which is adapted to pierce through the hank threads bundle 12 during a downward movement thereof. A support 13 positioned on the periphery of said rod 10 has two arm plates 14 and 14' extending from the support 13 substantially along the winding direction of hank thread. The levers 15 and 15' are outwardly curved and pivotably mounted to the arm plates 14 and 14' through their bent portion. The levers 15 and 15' have a spring 16 interposed between said levers and secured to them. Two rollers 25 are rotatably mounted at the end portions of the levers and pressed against said rod 10. Two lea leading pipes 17 and 17' are secured to the other end portions of the levers through the upper portions of them and the pipes respectively are inwardly curved (see FIG. 5). A lea leading pipe 17 has at its lower end a lea guiding cap 18 having a dull end and other pipe 17' has at its lower end a lea receiving cap 20 having an opening accommodating or matching with said lea guiding cap 18.

Within the opening of said lea receiving cap 19, a chuck pawl 20 having a spring is inserted. When said rollers 25 of the levers 15 and 15' press the periphery of the rod 10, the distance between the ends of said lea leading pipes 17 and 17' is kept larger than that of the width of said hank threads bundle owing to the effect of the spring 16. When said levers 15 and 15' are outwardly opened by a suitable means, the both ends come close to each other and the lea guiding cap 18 of said lea leading pipe 17 is passed through the opening 21 formed at the pointed head 11 of said rod 10 and inserted into the lea receiving cap 19 so as to open the chuck pawl 20 and engaged with the pawl. When said support 13 is lowered, it strikes on abutting plate 22 horizontally positioned around the rod 10. Said levers 15 and 15' are opened by the tapered portion 23 formed on a lower end of a reversed and truncated conical body 24 having a central bore through which said rod 10 is slidably mounted. The reversed and truncated conical body 24 is secured to the end of said cylinder 6.

In order to prevent said cylinder 6 and said piston 8 installed in the cylinder from revolving around the longitudinal center line of them, a slot 26 lengthwise formed on the outer periphery of said cylinder, a guiding boss 27 inserted through the metal 7 and fitted into the slot 26, a slot 28 formed on an outer periphery of the piston 8 and a guiding boss 29 fitted into the slot 28 through the cylinder wall are adapted to the lea making apparatus of the present invention.

The operation of the lea making apparatus illustrated will be described as follows.

Figure 7:
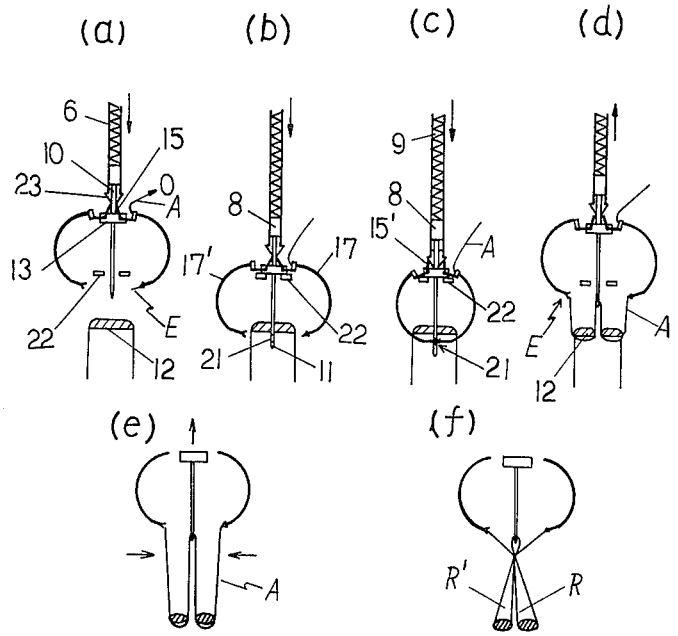
Figure 8:
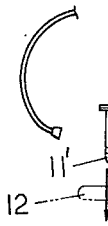
FIG. 8 is a front view illustrating the other embodiment of the rod.

First, the lea thread A is pulled out from the supply source O and lead through the lea leading pipe 17, the end E of the lea thread A being projected through the lea guiding cap 18. Then, a suitable volume of hank thread 5 is wound on the hank frame 1 and the frame is stopped at the position as shown in FIG. 5. Particularly, the operation and function of the cylinder 6 and the rod 10 is described with reference to FIG. 7 (*a*), (*b*), (*c*), (*d*), (*e*) and (*f*). As shown in FIG. 7 (*a*) and (*b*), the cylinder 6 and the rod 10 are lowered together or simultaneously in order to pierce the hank thread bundle 12 with the pointed end 11 of the rod 10, and then said lea leading pipe 17 and lea receiving pipe 17' are prepared in open-scissors condition to embrace the hank thread bundle. During the steps (*b*) and (*c*), the support 13 on the lowering cylinder 6 at last strikes the abutting plate 22 and the lowering movement of the rod 10 is ceased. Then, only the cylinder 6 is forced to lower further against the effect of the spring 9 and telescopically slide along the outer periphery of the piston 8, thereby the tapered face 23 formed at the lower end of said cylinder 6 pushing open outwardly the upper ends of the levers 15 and 15'. Consequently, each end portion of said lea leading pipe 17 and lea receiving pipe 17' are engaged with each other in the space of said opening 21 and the hank thread bundle 12 is completely embraced by the ring of the both pipes 17 and 17'.

At this step (*c*) of FIG. 7, the cylinder 6 stops its downward movement at the predetermined lowest limit position of it. Next, the cylinder 6 is raised as shown in FIG. 7 (*d*) and the both pipes 17 and 17' are returned to the opened positions of them.

Accordingly, the lea end E projected out from the lea leading pipe 17 is held between the pawls 20 of the lea receiving pipe 17' and extending through the opening 21 of the pointed head 11. In consequence of the raising of the cylinder 6 and therefore the rod 10, the lea end E is pulled up through the hank thread 12 as shown in FIG. 7(*d*). As a result of the pulling up, the hank thread 12 is divided and bundled by means of the U-shape lea threads connected to each other at their top ends positioned in the opening 21 of the rod 10. During the lea making process of the present invention, the lea thread is continuously supplied without tension and therefore it is freely and smoothly lead through the lea leading pipe 17 and the opening 21 of the rod 10.

After the cylinder 6 is raised at the predetermined uppermost limit position, four runs of the lea thread extending between the opening of the rod 10 and the hank thread 12 are collected together and their positions situated under the pointed head 11 are tied together by means of the conventional or known threads tier mechanism or some tape, in order to form lea thread chains or rings R and R′ or function a lea making operation. After the cutting operation of the lea thread, the bundled hank thread 12 is removed from the hank frame 1 and the next lea making step is carried out. The step for making the leas is repeatedly and continuously conducted.

The present invention has been apparently described or explained with reference to the particular embodiments of the lea making step for simultaneously making two lea chains. However, now it has been necessary to divide the hank threads of the larger volume such as woolen yarn into a number of bundles of the hank threads. The present invention can be applied to such occation of bundling or lea making. In this occation, the rod 10 having two pointed heads 11 and 11′ as shown in FIG. 5 is used in order to divide the hank threads into several bundles.

Furthermore, the pointed head 11 of the rod 10 may be made rotatable around its longitudinal axis and the opening 21 of the pointed head may be made as a hook-like groove. The operation of the rotatable pointed head having a hook-like groove will be described as fellows.

At the uppermost limit position of the cylinder 6, the pointed head having the hooklike groove is rotated for 90° and the loop of the hank thread is removed from the groove after the runs of the hank thread are tied. Accordingly, the lea having a shape of ∝ is obtained.

As described, according to the present invention, during the first step, the cylinder 6, the piston 8 and the rod 10 are integrally lowered in order to pierce the end portion of the rod 10 through the bundle of hank threads 12 and simultaneously the inwardly curved or bent lea leading pipe 17 and receiving pipe 17′ are kept in their open-scissors position to embrace the hank thread bundle. During the second step, only the cylinder 6 is forced down and both pipes 17 and 17′ come close together and embrace the hank thread bundle. It is noted that the respective operations of two kinds can be done by a simple movement of single cylinder, so that the lea making operation of the present invention can be advantageously done by means of a simple constructed mechanism or apparatus and manually at will. Now, the tyeing apparatus of the present invention will be explained by way of an embodiment in conjunction with the accompanying drawings of FIGS. 9–12.

Refering now to FIG. 9, a reference numeral 1d is a tubular body having a bent portion. An end **3*d* of the bent portion 2*d* is formed as opening. A base portion of the tubular body is inserted into and penetrates a wall of a hollow box 4*d* and is rotatably supported. A rotating mechanism 5*d* comprises a motor 6*d* and a transmission device 7*d*. An end portion of a transmission shaft 8*d* of said mechanism is fittingly connected with the base portion of the tubular body 1*d* so as to give an axial rotation to the tubular body. The reference numeral 9*d* shown in FIG. 10 is an air hole provided in a portion inserted into the hollow box 4*d* of the tubular body 1*d*. A suction pipe 10*d* opens into the hollow box 4*d*. Said suction pipe is connected to a suction pump V or the like (not shown), thereby air being able to be sucked through the hollow box 4 from an end of the bent portion 2*d* of the tubular body 1*d***.

Said tubular body **1*d*** may be provided with an automatic stop device employing the known electric circuit in order to stop after finishing a turn. Now, an embodiment of the present invention of the above automatic stop mechanism is as follows.

A change-over micro switch MS is inserted between both terminals of a push botton switch provided in a circuit for a motor. A movable member AD closing the micro switch is so mounted as to fit the rotatable wheel R into the circumferential groove formed on the disc C integrally rotatably engaged with the tubular body 1d. The rotatable wheel R is mounted on the end portion of an electric member B by which member said movable member AD is pushed to close the micro switch.

Accordingly, when the push botton switch S is pushed to start the operation of the motor, said tubular body 1d and said disc C are revolved and the rotatable wheel R rides on the circumferential wall of the disc, so that the elastic member B pushes the micro switch MS into its closed condition and the circuit for motor is kept in self-sustained condition. After the rotatable wheel R is revolved a turn, the wheel R falls into the groove of the disc to open the micro switch MS, thereby automatically stopping the motor.

The reference numerals **11*d* and 11′*d* show thread guiding frames secured on the both sides of the tubular body 1*d*, and 12*d* is a thread leading member mounted on the bent portion of the tubular member 1*d*. While the threads 13*d* are conveniently shown in a set of two threads, the number of the thread is not to be limited thereto. Said bent portion of the tubular body 1d** is preferably positioned horizontally during the stopped condition of the apparatus of the present invention.

An embodiment of the present invention will be described with reference to the apparatus for treating the ends of the lea. According to the present invention, the ends of the lea and hank thread to be tied are raised and firmly combined together irrespective of the shapes of the lea such as ∝ , W, and a series of U. Then, the thread portion to be tied is moved so as to be hooked on the bent portion of said tubular body as shown in FIG. 12 (1).

It is preferred to turn or extend outward a little the end portions of the thread hooked on the bent portion. The hooked thread is cut at the upper ends of it if necessary and the ends are freed, then turn on the motor and the suction pump. As a result, the thread is tied according to the steps of FIG. 12 (1–7).

The tying steps of the threads will be described with reference to the drawings.

2. The bent portion 2d starts to take up the lower portion of the threads.
3. The hooked portion of the thread is lead toward the bent portion.
4. Then, the bent portion faces up and the thread surrounds around the periphery of the bent portion and the opening 3d of the end of the bent portion is approached to the free ends of the threads.
5. The upper portion of the thread is sucked into the opening.
6. Then, in this condition of the thread, the bent portion revolves a turn and stops.
7. The apparatus of the invention is moved or returned along the opposite direction in order to pull the thread through the free ends of them and as a result the thread is took off and a knot consequently is made.

As apparent from the foregoing detailed description, according to the present invention, the thread guiding frames 11d and 11'd are adapted to guide the thread to a suitable position and the thread leading member 12*d* for leading the thread from the outer corner of the bent member to the bent member itself. The provision of the thread guiding frames and the thread leading member employed in the thread tying apparatus of the present invention can be cancelled without hindrance, if the apparatus makes a forward movement toward the thread in order to extend upper and lower portions of the thread outwardly. Also, the apparatus of the present invention can be operated manually without using the electric motor.

The foregoing description and the drawings are given merely to explain and illustrate the present invention, and the manner in which it may be performed, and the invention is not to be limited thereto, except insofar as the appended claims are so limited since those skilled in the art who have the disclosure will be able to make modifications and variations therein without departing from the scope and spirit of the invention.

What is claimed is:

1. A lea making mechanism of a reeling machine comprising:

a cylinder (6) having a tapered face (23), said cylinder being mounted for up and down movement on an upper portion of a machine frame, a piston (8) situated within said cylinder (6) and pressed downwardly by a spring (9) received in said cylinder, a rod (10) integrally mounted to said piston (8) and extending downward, said rod being formed at its lower end with a pointed head (11) and an opening (21), a support (13) mounted on the intermediate portion of said rod (10), levers (15 and 15') outwardly bent and pivotably mounted on the support at their bent portion, a lea leading pipe (17) and a lea receiving pipe (17') secured to said levers so as to spread to an open-scissors position wider than the width of a hank thread bundle by means of a spring tensioned between said levers, and an abutting plate (22) adapted to be struck with said support (13) during the downward movement of the cylinder and the piercing movement of said pointed head of said rod through the hank threads, whereby owing to the forced downward movement of said cylinder only, said tapered face (23) of the cylinder pushes open said levers and the lower ends of both pipes (17 and 17') are inserted in their closed-scissors position through said opening (21).

* * * * *